US010452086B2

(12) United States Patent
Feng et al.

(10) Patent No.: US 10,452,086 B2
(45) Date of Patent: Oct. 22, 2019

(54) DIGITAL REGULATOR HAVING REFERENCE-VOLTAGE-BASED INITIALIZATION PHASE AND METHOD FOR CONTROLLING THE SAME

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Xuehuan Feng, Beijing (CN); Xuelian Cheng, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 16/021,869

(22) Filed: Jun. 28, 2018

(65) Prior Publication Data

US 2019/0204862 A1 Jul. 4, 2019

(30) Foreign Application Priority Data

Jan. 2, 2018 (CN) ..... 2018 1 0004066

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/575
See application file for complete search history.

(56) References Cited

U.S. PATENT DOCUMENTS

2011/0187339 A1* 8/2011 Trattler ..... H02M 3/156 323/283
2016/0336870 A1* 11/2016 Halim ..... H02M 1/4225

FOREIGN PATENT DOCUMENTS

CN 105676933 A 6/2016

* cited by examiner

*Primary Examiner* — Jue Zhang
*Assistant Examiner* — Trinh Q Dang
(74) *Attorney, Agent, or Firm* — Kinney & Lange, P.A.

(57) ABSTRACT

A digital regulator includes a voltage comparison circuit, a counter, a decoder and a switch circuit. At an initialization phase, the voltage comparison circuit is configured to compare the reference voltage signal and a first signal to output a first level signal, and the counter is configured to initialize and output an initialization signal as a control signal according to the first level signal. At an operation phase, the voltage comparison circuit is configured to compare the reference voltage signal and an output terminal of the switch circuit to output a second level signal, and the counter is configured to count according to the second level signal and output the control signal. The decoder is configured to turn on the plurality of switch units according to the control signal from the counter.

10 Claims, 4 Drawing Sheets

DIGITAL REGULATOR HAVING REFERENCE-VOLTAGE-BASED INITIALIZATION PHASE AND METHOD FOR CONTROLLING THE SAME

CROSS-REFERENCE TO RELATED APPLICATION(S)

This application claims priority to the Chinese Patent Application No. 201810004066.6, filed on Jan. 2, 2018, which is incorporated herein by reference in its entirety.

TECHNICAL FIELD

The present disclosure generally relates to the field of electronic regulation, and more particularly, to a digital regulator and a method for controlling the same.

BACKGROUND

Digital regulators, especially digital Low Dropout Regulators (D-LDOs for short), are applied in the field of power management due to their good process mobility and low operating voltage.

SUMMARY

According to a first aspect of the present disclosure, there is provided a digital regulator, including a voltage comparison circuit having an input terminal, a feedback input terminal, and an output terminal, wherein the input terminal of the voltage comparison circuit receives a reference voltage signal; a counter having an input terminal electrically coupled to the output terminal of the voltage comparison circuit; a decoder having an input terminal electrically coupled to an output terminal of the counter; and a switch circuit comprising a plurality of switch units, wherein the switch circuit has an input terminal electrically coupled to an output terminal of the decoder, and an output terminal electrically coupled to the feedback input terminal of the voltage comparison circuit, wherein, the voltage comparison circuit is configured to output a first level signal according to a sub-voltage range to which the reference voltage signal belongs, and output a second level signal by comparing the reference voltage signal with an output voltage of the switch circuit; the counter is configured to output an initialization signal according to the first level signal and output a control signal according to the second level signal, respectively; and the decoder is configured to set a number of switch units to be initially turned on among the plurality of switch units according to the initialization signal, and set a number of switch units to be turned on among the plurality of switch units according to the control signal.

In an example, the voltage comparison circuit includes a first voltage comparator and a second voltage comparator, and the input terminal of the counter comprises a first input terminal and a second input terminal; an output terminal of the first voltage comparator is electrically coupled to the first input terminal of the counter, the output terminal of the switch circuit is electrically coupled to a first input terminal of the first voltage comparator, an output terminal of the second voltage comparator is electrically coupled to the second input terminal of the counter, a first input terminal of the second voltage comparator receives a first signal, and second input terminals of the first voltage comparator and the second voltage comparator are coupled and receive the reference voltage signal; the second voltage comparator is configured to compare the reference voltage signal with the first signal and output the first level signal; and the first voltage comparator is configured to compare the reference voltage signal with the output voltage of the switch circuit and output the second level signal.

In an example, a voltage value of the first signal is an output voltage value when fifty percent of transistors in the switch circuit are turned on.

In an example, the voltage comparison circuit includes a first voltage comparator, a second voltage comparator, a third voltage comparator and a fourth voltage comparator, the input terminal of the counter comprises a first input terminal, a second input terminal and a third input terminal, and the third voltage comparator and the fourth voltage comparator have enabling terminals; an output terminal of the first voltage comparator is electrically coupled to the first input terminal of the counter, and the output terminal of the switch circuit is electrically coupled to a first input terminal of the first voltage comparator; an output terminal of the second voltage comparator is electrically coupled to the enabling terminals of the third voltage comparator and the fourth voltage comparator, and a first input terminal of the second voltage comparator receives a first signal; an output terminal of the third voltage comparator is electrically coupled to the second input terminal of the counter, and a first input terminal of the third voltage comparator receives a second signal; an output terminal of the fourth voltage comparator is electrically coupled to the third input terminal of the counter, and a first input terminal of the fourth voltage comparator receives a third signal; and second input terminals of the first voltage comparator, the second voltage comparator, the third voltage comparator, and the fourth voltage comparator are electrically coupled and receive the reference voltage signal; wherein, the second voltage comparator is configured to compare the reference voltage signal with the first signal and output an enabling signal; the enabling terminal of the third voltage comparator receives the enabling signal, and in response to the enabling signal being active, compares the reference voltage signal with the second signal and outputs the first level signal; the enabling terminal of the fourth voltage comparator receives the enabling signal, and in response to the enabling signal being active, compares the reference voltage signal with the third signal and outputs the first level signal; and the first voltage comparator is configured to compare the reference voltage signal with the output voltage of the switch circuit and output the second level signal, wherein the enabling signal is not active for the third voltage comparator and the fourth voltage comparator at the same time.

In an example, the first signal, the second signal, and the third signal equally divide a voltage range between a maximum output voltage value and a minimum output voltage value of the digital regulator into a first sub-voltage range, a second sub-voltage range, a third sub-voltage range, and a fourth sub-voltage range.

In an example, the digital regulator further comprises a switch selection circuit coupled to the second input terminal of the first voltage comparator and configured to select one of a plurality of voltage signals as the reference voltage signal.

According to another aspect of the embodiments of the present disclosure, there is provided a method for controlling the digital regulator according to the embodiments of the present disclosure, including receiving a reference voltage signal, generating an initialization signal according to a sub-voltage range to which the reference voltage signal belongs, and setting a number of transistors to be initially turned on in the switch circuit according to the initialization signal; comparing a voltage output by the switch circuit with the reference voltage signal, and obtaining a second level signal according to a comparison result; and controlling a number of switch units to be turned on in the switch circuit according to the second level signal.

In an example, a level value of the first signal is set to divide a voltage range between a maximum output voltage value and a minimum output voltage value of the digital regulator into a first sub-voltage range and a second sub-voltage range; and generating an initialization signal includes comparing the first signal with the reference voltage signal, and outputting a first level signal according to a comparison result; and if the first level signal is "0", determining that the reference voltage signal belongs to the first sub-voltage range and outputting a first initialization signal; otherwise, determining that the reference voltage signal belongs to the second sub-voltage range and outputting a second initialization signal.

In an example, a level value of the first signal is an output voltage value when fifty percent of the switch units in the switch circuit are turned on.

In an example, level values of the first signal, the second signal and the third signal are set to divide a voltage range between a maximum output voltage value and a minimum output voltage value of the digital regulator into a first sub-voltage range, a second sub-voltage range, a third sub-voltage range and a fourth sub-voltage range, and generating an initialization signal includes comparing the reference voltage signal with the first signal, and if the reference voltage signal is less than the first signal, outputting an enabling signal at a first level; otherwise, outputting an enabling signal at a second level; when the enabling signal is at the first level, comparing the reference voltage signal with the second signal, and if the reference voltage signal is less than the second signal, determining that the reference voltage signal belongs to the first sub-voltage range and outputting a first initialization signal; otherwise, determining that the reference voltage signal belongs to the second sub-voltage range and outputting a second initialization signal; and when the enabling signal is at the second level, comparing the reference voltage signal with the third signal, and if the reference voltage signal is less than the third signal, determining that the reference voltage signal belongs to the third sub-voltage range and output a third initialization signal; otherwise, determining that the reference voltage signal belongs to the fourth sub-voltage range and outputs a fourth initialization signal.

BRIEF DESCRIPTION OF THE DRAWINGS

Other features, purposes, and advantages of the present application will become more apparent by reading through the detailed description of non-limiting embodiments with reference to the following accompanying drawings.

DETAILED DESCRIPTION

The present application will be further described in detail below with reference to the accompanying drawings and embodiments. It can be understood that the specific embodiments described herein are merely illustrative of related embodiments instead of limitations on the embodiments. It should also be understood that for the convenience of description, only the parts related to the embodiments are shown in the accompanying drawings.

It should be understood that the embodiments in the present application and the features in the embodiments can be combined with each other without conflict. The present application will be described in detail below with reference to the accompanying drawings and in combination with the embodiments.

Figure 1:
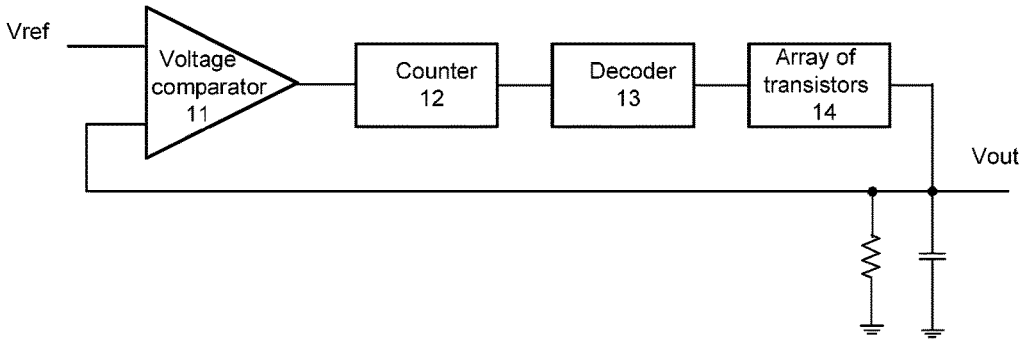
FIG. 1 illustrates an exemplary circuit diagram of a digital regulator.

FIG. 1 illustrates a schematic block diagram of a digital regulator. As shown in FIG. 1, the digital regulator 10 may include a voltage comparator 11, a counter 12, a decoder 13, and a switch circuit 14 including an array of transistors, wherein the counter 12, the decoder 13, and the switch circuit 14 constitute a feedback path. The counter 12 determines a difference between an output voltage value of the array of transistors 14 and a reference voltage by detecting an output result of the comparator 11. The decoder 13 controls a proportion of PMOS transistors to be turned on in the switch circuit according to a value output by the counter 12, so as to change an output voltage value of the switch circuit, and changes the proportion of the PMOS transistors to be turned on by continuously detecting a feedback result, so as to adjust the output voltage value until the difference between the output voltage value and the reference voltage is minimum. In the embodiment of FIG. 1, the number of transistors in the switch circuit is a fixed value, and when all the transistors are turned on, an output voltage value at an output terminal of the switch circuit is also a fixed value. When the output voltage value is large, a lot of PMOS transistors need to be turned on, thereby resulting in a long response time of a D-LDO.

Figure 2:
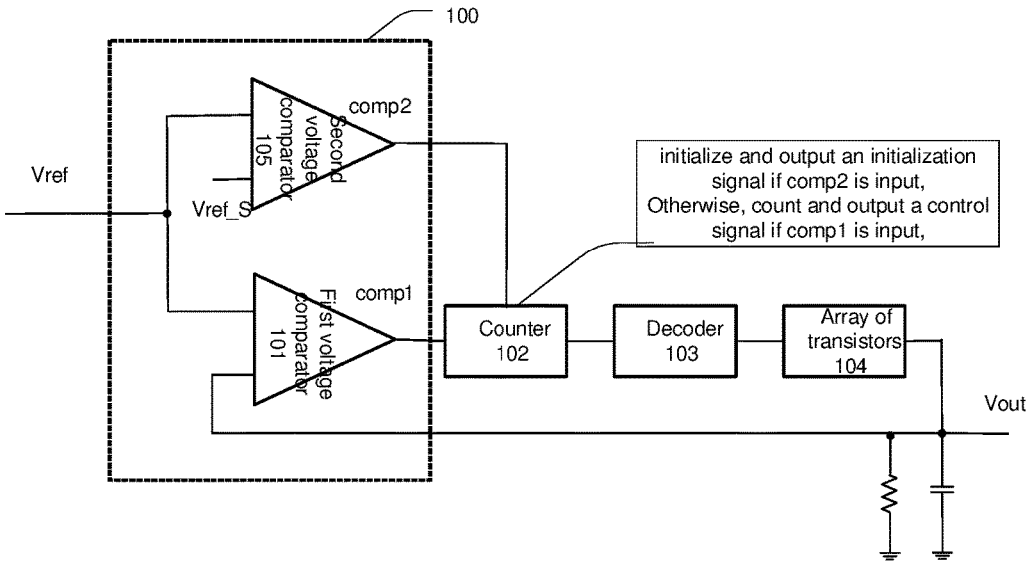
FIG. 2 illustrates an exemplary circuit diagram of a digital regulator according to an embodiment.

Thus, the embodiments of the present disclosure provide a digital regulator. FIG. 2 illustrates an exemplary schematic circuit diagram of a digital regulator according to an embodiment of the present application. According to the embodiment of the present disclosure, a voltage range between a maximum output voltage value and a minimum output voltage value of the digital regulator is divided into a plurality of sub-voltage ranges. Each sub-voltage range is provided with a corresponding initialization signal. As shown in FIG. 2, the digital regulator may include a voltage comparison circuit 100, a counter 102, a decoder 103, and a switch circuit 104 including a plurality of switch units arranged in an array. The counter 102 is electrically coupled to an input terminal of the switch circuit 104 through the decoder 103. The voltage comparison circuit 100 is electrically coupled to an input terminal of the counter 102. The voltage comparison circuit 100 receives a reference voltage signal Vref. An output terminal of the switch circuit 104 is electrically coupled to an input terminal of the voltage comparison circuit 100. According to the embodiment of the present disclosure, the voltage comparison circuit 100 outputs a first level signal according to a sub-voltage range to which a voltage value of the reference voltage signal Vref belongs. The counter 102 outputs an initialization signal according to the first level signal, and the decoder 103 configures a number or proportion of switch units to be initially turned on in the switch circuit 104 according to the initialization signal.

The voltage comparison circuit 100 is further configured to compare the reference voltage with an output voltage of the switch circuit and output a second level signal according to a comparison result. The counter 102 controls a number of switch units to be turned on in the switch circuit 104 through the decoder 103 according to the second level signal.

The switch unit may be implemented using PMOS transistors, NMOS transistors, or TFT thin film transistors.

In the present embodiment, the number of the switch units which are initially in a turn-on state in the switch circuit is set using the voltage comparison circuit 100. When it needs to regulate the output voltage to a high voltage, there are a large number of transistors to be turned on in an initial state, and thus adjustment may be started from a high initial voltage. When it needs to regulate the output voltage to a low voltage, there are a small number of transistors to be turned on in the initial state, and thus adjustment may be started from a low initial voltage. Therefore, a response speed of the regulation can be improved.

In some embodiments, the voltage comparison circuit 100 may comprise a first voltage comparator 101 and a second voltage comparator 105. An output terminal of the first voltage comparator 101 is coupled to a first input terminal of the counter 102, the output terminal of the switch circuit 104 is coupled to a first input terminal of the first voltage comparator 101, and an output terminal of the second voltage comparator 105 is coupled to a second input terminal of the counter 102. A first input terminal of the second voltage comparator 105 receives a first signal, and second input terminals of the first voltage comparator 101 and the second voltage comparator 105 are coupled and receive the reference voltage signal. The second voltage comparator 105 is configured to compare the reference voltage signal with the first signal and output the first level signal according to a comparison result. The first voltage comparator 101 is configured to compare the reference voltage signal with the output voltage of the switch circuit and output the second level signal according to a comparison result.

An operation principle of a digital regulator will be described below by taking a number of switch units in a switch circuit thereof being 256 as an example. The reference voltage Vref input to the second voltage comparator 105 is compared with the first signal Vref_S. When Vref≥Vref_S, an output comp2 of the second voltage comparator 105 is "1", which indicates that when the digital regulator is finally stabilized, the output voltage is greater than the first signal Vref_S. An initial value in the counter may be set to "11111111", that is, initial states of all the switch units in the switch circuit are a turn-on state. When Vref<Vref_S, the output comp2 of the second voltage comparator 105 is equal to "0", which indicates that when the D-LDO is finally stabilized, the output voltage is less than the first signal Vref_S. The initial value in the counter may be set to "00000000", that is, the initial states of all the transistors in the switch circuit are a turn-off state.

According to the embodiment of the present disclosure, when a reference voltage is firstly received, the second voltage comparator 105 operates to set the number of the transistors to be initially turned on in the switch circuit 104. The subsequent regulation of the output voltage is realized by the first voltage comparator 101. The first voltage comparator 101 compares Vref with the output voltage Vout to output a comp1 signal. When the comp1 signal is "0", it indicates Vref≥Vout; and when the comp1 signal is "1", it indicates that Vref<Vout. The output comp1 signal is used to control a count of the counter. For example, when the comp1 signal is "0", a value output by the counter 102 to the decoder 103 in one clock period is incremented, and when the comp1 signal is "1", the value output by the counter 102 to the decoder 103 in one clock period is decremented. A signal output by the decoder 103 controls the transistors in the switch circuit 104 to be turned on. The larger the number of transistors to be turned on in the switch circuit 104, the larger the value of the output voltage Vout; otherwise, the smaller the value of the output voltage Vout.

For example, the initial value of the counter may be set according to the comp2 signal, or may be set randomly according to practical application requirements. For example, ⅖, ⅔, etc. of all the transistors in the switch unit may be set to be turned on.

In some embodiments, the value of the first signal is an output voltage value when 50% of the transistors in the switch circuit 104 are turned on. It can be understood that the first signal may be set to any value between a maximum value and a minimum value of the output voltage of the digital regulator.

Figure 4:
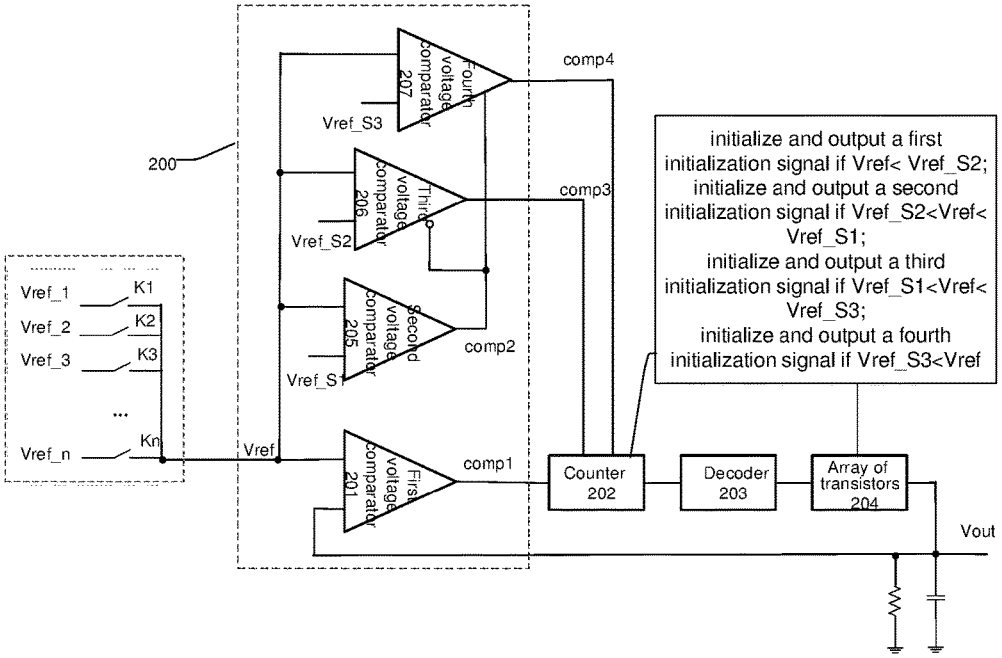
FIG. 4 illustrates an exemplary circuit diagram of a digital regulator according to yet another embodiment.

FIG. 4 illustrates an exemplary schematic circuit diagram of a digital regulator according to another embodiment of the present application. As shown in FIG. 4, the voltage comparison circuit 200 may include a first voltage comparator 201, a second voltage comparator 205, a third voltage comparator 206, and a fourth voltage comparator 207.

An output terminal of the first voltage comparator 201 is coupled to the first input terminal of the counter 202, and the output terminal of the switch circuit 204 is coupled to a first input terminal of the first voltage comparator 201; and an output terminal of the second voltage comparator 205 is coupled to enabling terminals of the third voltage comparator 206 and the fourth voltage comparator 207, and a first input terminal of the second voltage comparator 205 receives a first signal. An output terminal of the third voltage comparator 206 is coupled to the second input terminal of the counter 202, and a first input terminal of the third voltage comparator 206 receives a second signal. An output terminal of the fourth voltage comparator 207 is coupled to a third input terminal of the counter 202, and a first input terminal of the fourth voltage comparator 207 receives a third signal. Second input terminals of the first voltage comparator 201, the second voltage comparator 205, the third voltage comparator 206, and the fourth voltage comparator 207 are coupled and receive the reference voltage signal.

The second voltage comparator 205 is configured to compare the reference voltage signal with the first signal and output an enabling signal according to a comparison result. The third voltage comparator 206 receives the enabling signal. For example, when the enabling signal is "0", the third voltage comparator 206 is enabled to compare the reference voltage signal with the second signal and output the first level signal according to a comparison result. The fourth voltage comparator 207 receives the enabling signal, and when the enabling signal is "1", the fourth voltage comparator 207 is enabled to compare the reference voltage signal with the third signal and output the first level signal according to a comparison result.

The first voltage comparator 202 is configured to compare the reference voltage signal with the output voltage of the switch circuit 204 and output the second level signal according to a comparison result. The third voltage comparator 206 and the fourth voltage comparator 207 are not enabled at the same time.

An operation principle of a digital regulator will be described below by taking a number of transistors in a switch circuit thereof being 256 as an example. The first voltage comparator 201 compares the reference voltage signal with the first signal, and if the reference voltage signal is less than the first signal, the output enabling signal is "0"; otherwise, the output enabling signal is "1".

When the enabling signal is "0", the third voltage comparator 206 is enabled, that is, a valid enabling signal for the third voltage comparator 206 is a low level signal. The third voltage comparator 206 compares the reference voltage signal with the second signal and outputs the first level signal. The counter 202 outputs an initial turn-on signal corresponding to a voltage range to which the current reference voltage signal belongs to the decoder 203 according to the first level signal. The decoder 203 controls a number of switch units to be initially turned on in the switch circuit 204 according to the initial turn-on signal.

When the enabling signal is "1", the fourth voltage comparator 207 is enabled. That is, a valid enabling signal for the fourth voltage comparator 207 is a high level signal. The fourth voltage comparator 207 compares the reference voltage signal with the third signal and outputs the first level signal. The counter 202 outputs an initial turn-on signal corresponding to a voltage range to which the current reference voltage signal belongs to the decoder 203 according to the first level signal. The decoder 203 controls a number of switch units to be initially turned on in the switch circuit 204 according to the initial turn-on signal.

For example, the first signal Vref_S1, the second signal Vref_S2, and the third signal Vref_S3 divide the voltage range between the maximum output voltage value and the minimum output voltage value of the digital regulator into a first sub-voltage range, a second sub-voltage range, a third sub-voltage range and a fourth sub-voltage range. If the number of divided sub-voltage ranges is increased, the response speed can be improved.

For example, when all the transistors in the digital regulator are turned on, the output voltage is 2v, and when all the transistors in the digital regulator are turned off, the output voltage is 0v. The first signal Vref_S1, the second signal Vref_S2, and the third signal Vref_S3 are set to 0.5v, 1v and 1.5v respectively. The input reference signal Vref_K is 0.8v, and the second voltage comparator 202 outputs comp1=0. When comp1=0, the third voltage comparator 206 is enabled and outputs comp3=1. comp3 is output to the counter 202, and the preset initialization signal of the counter 202 is "00000100" as the number of transistors to be turned on corresponding to 0.5v. As can be seen, according to the embodiment of the present disclosure, the initial voltage of the digital regulator is adjusted to 0.5v, which improves the response speed. If the input Vref_K is 1.2v, the second voltage comparator 202 outputs comp1=1. At this time, the fourth voltage comparator 207 is enabled, and outputs comp4=0. comp4 is output to the counter 202, and the preset initialization signal of the counter 202 is "0100000" as the number of transistors to be turned on corresponding to 1.5v. According to the embodiment of the present disclosure, the initial voltage of the digital regulator is adjusted to 1.5V, which improves the response speed.

It can be understood that the voltage range between the maximum output voltage value and the minimum output voltage value of the digital regulator may be equally divided or non-equally divided, which may be determined according to practical requirements.

Figure 3:
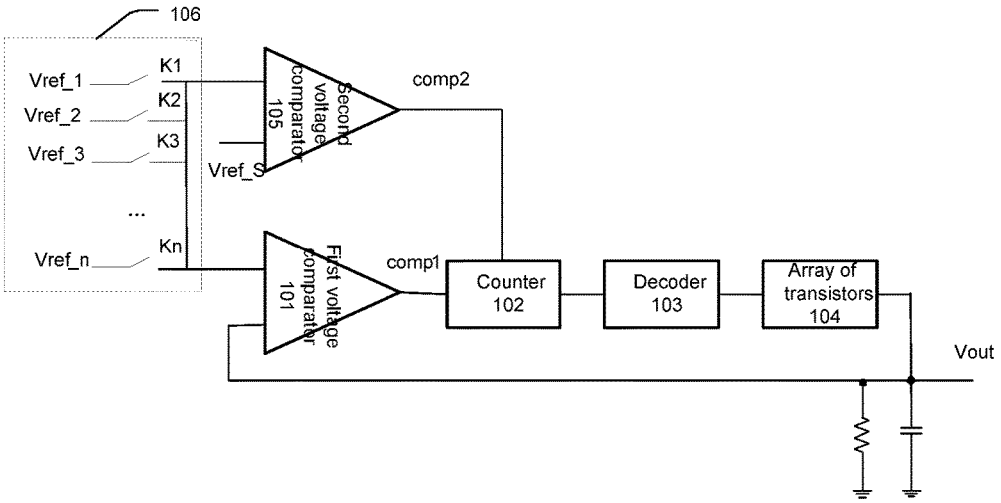
FIG. 3 illustrates an exemplary circuit diagram of a digital regulator according to another embodiment.

The digital regulator according to the present embodiment further comprises a switch selection circuit, which will be described below with reference to FIG. 3. FIG. 3 illustrates an exemplary schematic circuit diagram of a digital regulator according to another embodiment of the present application. As shown in FIG. 3, the switch selection circuit 106 is coupled to the second input terminal of the first voltage comparator 101 and is configured to select a reference voltage signal from a plurality of voltage signals. In the figure, Vref_1, Vref_2, . . . , Vref_n represent a plurality of input reference voltages respectively, and K_1, K_2, . . . , K_N represent switches. One of the switches is turned on so that one of the reference voltages is coupled to the second input terminal of the first voltage comparator 101.

The embodiments of the present disclosure further provide a method for controlling a digital regulator.

Figure 5:
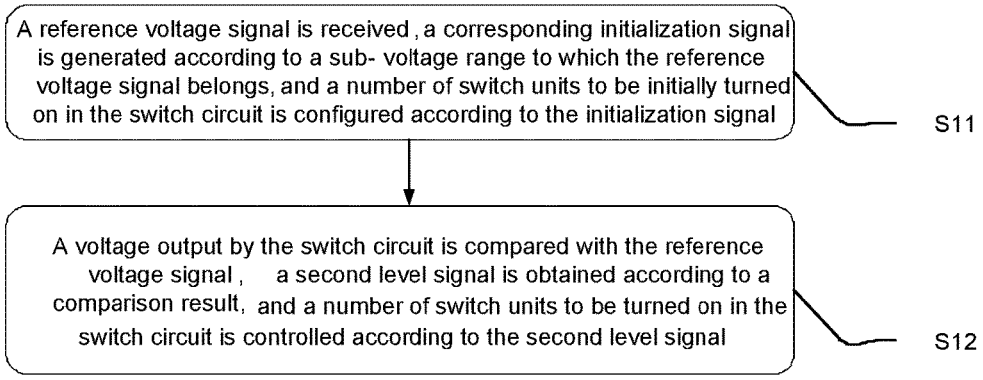
FIG. 5 illustrates an exemplary flowchart of a method for controlling a digital regulator according to an embodiment.

FIG. 5 illustrates an exemplary flowchart of a method for controlling a digital regulator according to an embodiment of the present application. As shown in FIG. 5, the method according to the embodiment of the present disclosure may include the following steps.

In step S11, a reference voltage signal is received, a corresponding initialization signal is generated according to a sub-voltage range to which the reference voltage signal belongs, and a number of switch units to be initially turned on in the switch circuit is configured according to the initialization signal.

In step S12, a voltage output by the switch circuit is compared with the reference voltage signal, a second level signal is obtained according to a comparison result, and a number of switch units to be turned on in the switch circuit is controlled according to the second level signal.

The voltage range between the maximum output voltage value and the minimum output voltage value of the digital regulator may be divided into a plurality of sub-voltage ranges, and a number of switch units to be initially turned on in the switch circuit is configured correspondingly to a sub-voltage range to which the reference voltage signal belongs by determining the sub-voltage range, so as to effectively improve the response efficiency of the digital regulator.

Figure 6:
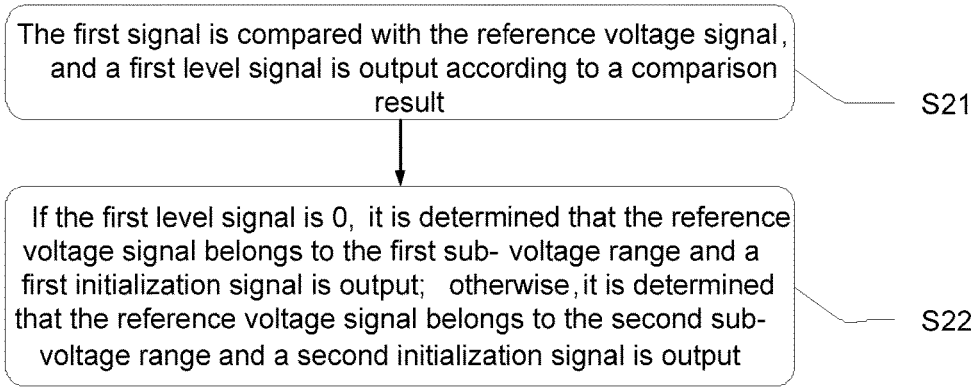
FIG. 6 illustrates an exemplary flowchart of step S11 of FIG. 5.

FIG. 6 illustrates an exemplary flowchart of step S11 of FIG. 5. As shown in FIG. 6, the preset voltage value is a first signal between the maximum output voltage value and the minimum output voltage value of the digital regulator, so that the first signal divides the voltage range between the maximum output voltage value and the minimum output voltage value of the digital regulator into a first sub-voltage range and a second sub-voltage range. Generating the initialization signal according to the sub-voltage range to which the reference voltage signal belongs may include the following steps.

In step S21, the first signal is compared with the reference voltage signal, and a first level signal is output according to a comparison result.

In step S22, if the first level signal is "0", it is determined that the reference voltage signal belongs to the first sub-voltage range and a first initialization signal is output; otherwise, it is determined that the reference voltage signal belongs to the second sub-voltage range and a second initialization signal is output.

The detailed description of the above method has been described in the description of FIG. 3 and will not be described here.

In some embodiments, a voltage value of the first signal may be an output voltage value when half of the transistors in the switch circuit are turned on. It can be understood that the voltage value of the first signal is not limited to the above value, and may also be set to any voltage value between the maximum output voltage value and the minimum output voltage value of the digital regulator.

Figure 7:
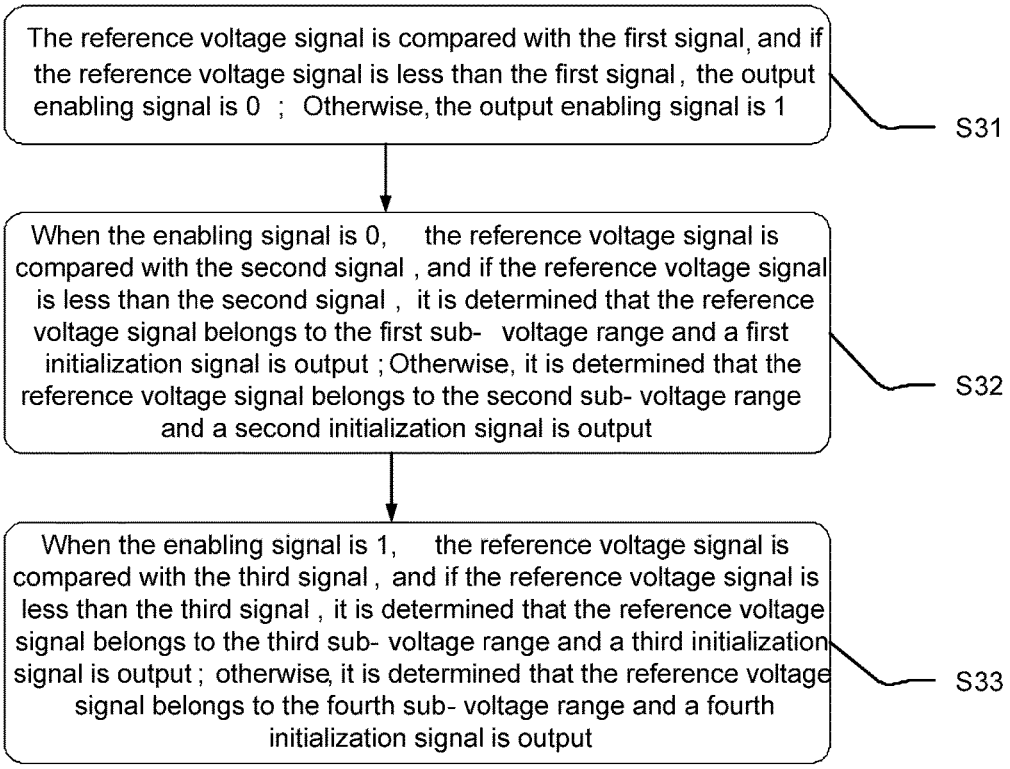
FIG. 7 illustrates another exemplary flowchart of step S11 of FIG. 5.

FIG. 7 illustrates another exemplary flowchart of step S11 of FIG. 5. As shown in FIG. 7, a first signal, a second signal, and a third signal having a voltage value between the maximum output voltage value and the minimum output voltage value of the digital regulator may be set. The first signal, the second signal, and the third signal divide the voltage range between the maximum output voltage value and the minimum output voltage value of the digital regulator into a first sub-voltage range, a second sub-voltage range, a third sub-voltage range, and a fourth sub-voltage range. Generating the initialization signal according to the sub-voltage range to which the reference voltage signal belongs may comprise the following steps.

In step S31, the reference voltage signal is compared with the first signal, and if the reference voltage signal is less than the first signal, the output enabling signal is "0"; otherwise, the output enabling signal is "1".

In step S32, when the enabling signal is "0", the reference voltage signal is compared with the second signal, and if the reference voltage signal is less than the second signal, it is determined that the reference voltage signal belongs to the first sub-voltage range and a first initialization signal is output; otherwise, it is determined that the reference voltage signal belongs to the second sub-voltage range and a second initialization signal is output.

In step S33, when the enabling signal is "1", the reference voltage signal is compared with the third signal, and if the reference voltage signal is less than the third signal, it is determined that the reference voltage signal belongs to the third sub-voltage range and a third initialization signal is output; otherwise, it is determined that the reference voltage signal belongs to the fourth sub-voltage range and a fourth initialization signal is output.

The detailed description of the above method is described in the description of FIG. 4 and will not be repeated here. It should be understood by those skilled in the art that the embodiments of the present disclosure are not limited to the technical solutions formed by a particular combination of the above technical features, but should also be covered by other technical solutions formed by any combination of the above technical features or equivalent features thereof without departing from the concept of the embodiments, for example, technical solutions which are formed by substituting the above features with the technical features disclosed in the present application having (but not limited to) similar functions.

We claim:

1. A digital regulator, comprising:

a voltage comparison circuit having an input terminal, a feedback input terminal, and an output terminal, wherein the input terminal of the voltage comparison circuit receives a reference voltage signal;

a counter having an input terminal electrically coupled to the output terminal of the voltage comparison circuit;

a decoder having an input terminal electrically coupled to an output terminal of the counter; and a switch circuit comprising a plurality of switch units, wherein the switch circuit has an input terminal electrically coupled to an output terminal of the decoder;

wherein the voltage comparison circuit is configured to, at an initialization phase, receive a first signal at the feedback input terminal, and compare the reference voltage signal and the first signal to output a first level signal, and at an operation phase, connect the feedback input terminal to an output terminal of the switch circuit, and output a second level signal by comparing the reference voltage signal with an output voltage of the switch circuit; and wherein the counter is configured to, at the initialization phase, initialize a control signal as an initialization signal according to the first level signal and output the control signal, and at the operation phase, count according to the second level signal and output the control signal; and wherein the decoder is configured to turn on the plurality of switch units according to the control signal from the counter.

2. The digital regulator according to claim 1, wherein the voltage comparison circuit comprises a first voltage comparator and a second voltage comparator, and the input terminal of the counter comprises a first input terminal and a second input terminal;

wherein an output terminal of the first voltage comparator is electrically coupled to the first input terminal of the counter, the output terminal of the switch circuit is electrically coupled to a first input terminal of the first voltage comparator, an output terminal of the second voltage comparator is electrically coupled to the second input terminal of the counter, a first input terminal of the second voltage comparator receives the first signal, and second input terminals of the first voltage comparator and the second voltage comparator are coupled to each other and receive the reference voltage signal; and wherein the second voltage comparator is configured to, at the initialization phase, compare the reference voltage signal with the first signal and output the first level signal; and wherein the first voltage comparator is configured to, at the operation phase, compare the reference voltage signal with the output voltage of the switch circuit and output the second level signal.

3. The digital regulator according to claim 1, wherein the voltage comparison circuit comprises a first voltage comparator, a second voltage comparator, a third voltage comparator and a fourth voltage comparator, the input terminal of the counter comprises a first input terminal, a second input terminal, and a third input terminal, and the third voltage comparator and the fourth voltage comparator have enabling terminals;

wherein an output terminal of the first voltage comparator is electrically coupled to the first input terminal of the counter, and the output terminal of the switch circuit is electrically coupled to a first input terminal of the first voltage comparator; and wherein an output terminal of the second voltage comparator is electrically coupled to the enabling terminals of the third voltage comparator and the fourth voltage comparator, and a first input terminal of the second voltage comparator receives a first signal; and wherein an output terminal of the third voltage comparator is electrically coupled to the second input terminal of the counter, and a first input terminal of the third voltage comparator receives a second signal; and wherein an output terminal of the fourth voltage comparator is electrically coupled to the third input terminal of the counter, and a first input terminal of the fourth voltage comparator receives a third signal; and wherein second input terminals of the first voltage comparator, the second voltage comparator, the third voltage comparator, and the fourth voltage comparator are electrically coupled and receive the reference voltage signal; and wherein the second voltage comparator is configured to compare the reference voltage signal with the first signal and output an enabling signal; and wherein the enabling terminal of the third voltage comparator receives the enabling signal, and in response to the enabling signal being active, compares the reference voltage signal with the second signal and outputs the first level signal; and wherein the enabling terminal of the fourth voltage comparator receives the enabling signal, and in response to the enabling signal being active, compares the reference voltage signal with the third signal and outputs the first level signal; and wherein the first voltage comparator is configured to compare the reference voltage signal with the output voltage of the switch circuit and output the second level signal, wherein the enabling signal is not active for the third voltage comparator and the fourth voltage comparator at the same time.

4. A method for controlling the digital regulator according to claim 1, comprising:

at the initialization phase, comparing the reference voltage signal and the first signal to output a first level signal at the voltage comparison circuit, initializing to control signal as the initialization signal according to the first level signal and outputting the control signal at the counter;

at the operation phase, comparing a voltage output by the switch circuit with the reference voltage signal to output the second level signal according to a comparison result at the voltage comparison circuit, and counting according to the second level signal and outputting the control signal at the counter; and turning on the plurality of switch units in the switch circuit according to the control signal from the counter.

5. The digital regulator according to claim 2, wherein a voltage value of the first signal is an output voltage value when fifty percent of the plurality of switch units are turned on.

6. The digital regulator according to claim 2, further comprising a switch selection circuit coupled to the second input terminal of the first voltage comparator and configured to select one of a plurality of voltage signals as the reference voltage signal.

7. The digital regulator according to claim 3, wherein the first signal, the second signal, and the third signal are a first output voltage value when fifty percent of transistors in the switch circuit are turned on, a second output voltage value when twenty-five percent of transistors in the switch circuit are turned on, and a third output voltage value when seventy-five percent of transistors in the switch circuit are turned on, respectively.

8. The method according to claim 4, wherein a level value of the first signal is an output voltage value when fifty percent of the plurality of switch units are turned on.

9. The method according to claim 4, wherein outputting the first level signal comprises:

comparing the reference voltage signal with the first signal, and if the reference voltage signal is less than the first signal, outputting an enabling signal at a first level; otherwise, outputting an enabling signal at a second level;

when the enabling signal is at the first level, comparing the reference voltage signal with a second signal to output the first level signal; and when the enabling signal is at the second level, comparing the reference voltage signal with a third signal to output the first level signal.

10. The method according to claim 9, wherein the first signal, the second signal, and the third signal are a first output voltage value when fifty percent of transistors in the switch circuit are turned on, a second output voltage value when twenty-five percent of transistors in the switch circuit are turned on, and a third output voltage when seventy-five percent of transistors in the switch circuit are turned on, respectively.

* * * * *